US006297455B1

(12) United States Patent
Wijnberg et al.

(10) Patent No.: US 6,297,455 B1
(45) Date of Patent: Oct. 2, 2001

(54) WIRELINE CABLE

(75) Inventors: Willem A. Wijnberg, Houston; Pete Howard, Bellville; Ramon Hernandez-Marti, Austin, all of TX (US)

(73) Assignee: Schkumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/574,414

(22) Filed: May 19, 2000

(51) Int. Cl.[7] ..... H01B 11/06
(52) U.S. Cl. ..... 174/113 R; 174/36
(58) Field of Search ..... 174/102 R, 105 R, 174/108, 113 R, 36, 115

(56) References Cited

U.S. PATENT DOCUMENTS 2,927,954 3/1960 Ellsworth .
3,602,632 * 8/1971 Ollis ..... 174/36
3,784,732 * 1/1974 Whitfill, Jr. ..... 174/108
4,440,974 * 4/1984 Naudet ..... 174/108
4,654,476 * 3/1987 Barnicol-Ottler et al. ..... 174/116
4,657,342 * 4/1987 Baiier ..... 350/96.23
4,658,089 * 4/1987 Guzy et al. ..... 174/113 R

* cited by examiner

*Primary Examiner*—Anthony Dinkins
*Assistant Examiner*—William H. Mayo, III
(74) *Attorney, Agent, or Firm*—John Ryberg; Brigitte Jeffery

(57) ABSTRACT

A cable that has a longitudinal axis and includes four insulated primary conductors which extend along the cable and define interstices between adjacent primary conductors. At least one insulated secondary conductor has a wire gauge smaller than the primary conductors and extends about the longitudinal axis of the cable. The at least one secondary conductor is at least partially nested in one of the interstices. An armor shield surrounds the primary and secondary conductors.

24 Claims, 3 Drawing Sheets

WIRELINE CABLE

BACKGROUND OF THE INVENTION

1. Field of the Invention

This invention relates to multi-conductor electrical cables of the type used in oilfield wireline logging cables.

Once an oil well is drilled, it is common to log certain sections of the well with electrical instruments. These instruments are referred to as "wireline" instruments, as they communicate with the logging unit at the surface of the well through an electrical wire or cable with which they are deployed. Such cables are used for transmitting power and for telemetry. Since down hole temperatures and pressures can reach, for example, 500° F. and sometimes up to 25,000 psi, the cables must be designed to withstand extreme environmental conditions.

2. Description of the Related Art

A standard cable in the oilfield industry is a seven-conductor design called a "heptacable." As shown in FIG. 1, the heptacable 2, generally 0.38–0.55 inches in diameter, includes six conductors 4 symmetrically wrapped around a center conductor 6. These types of heptacables are used extensively in the oilfield wireline logging industry, for the purpose of lowering and retrieving sensors and instruments capable of measuring acoustic, nuclear, resistivity, and nuclear magnetic resonance (NMR) properties of freshly drilled downhole rock formations and their fluid content. Other uses of the heptacable include cement analysis, perforating, PVT and fluid sampling, and other electro-mechanical services that may be required in oil and gas wells.

BRIEF SUMMARY OF THE INVENTION

We have developed an improved wireline cable construction that, while enabling a high degree of backwards compatibility with prior heptacables and the instruments they service, can provide an advantageously high current-carrying capacity while maintaining standard voltage ratings, leading to a substantial increase in the power delivery capacity of the cable, without any increase in its nominal diameter.

The wireline cable of the invention can provide high power delivery capacity during operation while maintaining good data transmission, e.g., high signal-to-noise ratio and low attenuation. By using heavy gauge (i.e., large diameter) primary conductors, more conductive material, e.g., copper, can be packed into a given cross-sectional area of the cable. Thus, the cable can provide increased power delivery capacity and improved data transmission characteristics when compared to a standard heptacable. The cable includes secondary conductors that allow it to be backward compatible with existing standard heptacables. The improved power capacity is especially advantageous for current and future downhole applications requiring higher power, while still meeting environmental, packaging, and flexibility requirements.

In one aspect, the invention features a flexible electrical wireline cable defining a longitudinal axis and having four insulated primary conductors, at least one insulated secondary conductor of a wire gauge smaller than the primary conductors, and an armor shield. The primary conductors extend along the cable and define interstices between adjacent primary conductors. The secondary conductor extends about the longitudinal axis of the cable and is at least partially nested in one of the interstices. The armor shield surrounds the primary and secondary conductors.

Embodiments of the invention may include one or more of the following. The primary conductors are arranged in a cross pattern about the longitudinal axis. The cable has at least three secondary conductors for a total number of at least seven conductors. The cable has an overall diameter, including the armor shield, of less than about 0.55 inch. The cable has a minimum bending radius of about 4 inches. The cable has five secondary conductors. The secondary conductor extends along the longitudinal axis of the cable. The primary conductors are twisted together about the secondary conductor. The cable further includes a non-conductive filler rod extending about the longitudinal axis of the cable and at least partially nested in the interstices formed by the primary conductors. The cable further includes a non-conductive filler rod extending along the longitudinal axis. The primary conductors are twisted together about the filler rod, e.g., made of a fluoropolymer.

The cable further includes a plurality of secondary conductors arranged symmetrically about the longitudinal axis. The primary conductors, the secondary conductor, and the armor shield define interstitial voids, and the cable further includes a semi- or non-conductive material, such as a cross-linked polymer, disposed in the voids. The secondary conductor has a wire gauge of between 24 AWG and 20 AWG.

The cable further includes a bedding layer, e.g., a binder tape and an extruded material, surrounding the primary and secondary conductors. The armor shield includes two layers of contrahelically wound fibers. The armor fibers include a material selected from a group consisting of steel, metals, and non-metals.

In another aspect, the invention features a flexible electrical cable defining a longitudinal axis and having four insulated primary conductors of a common wire gauge twisted together and extending along the cable, five insulated secondary conductor of a wire gauge larger than the wire gauge of the primary conductors, a bedding layer surrounding the primary and secondary conductors, and an armor shield surrounding the bedding layer. The primary conductors are arranged in a cross pattern about the longitudinal axis and define interstices between adjacent primary conductors. Four of the secondary conductors are each at least partially nested in one of said interstices, and the other secondary conductor extends along the longitudinal axis of the cable. The cable has an outer diameter of less than about 0.55 inch.

As used herein, the "longitudinal axis" of a cable is an imaginary axis that extends through the cross-sectional center of the cable and along the length of the cable from one end of the cable to another end of the cable.

The details of one or more embodiments of the invention are set forth in the accompanying drawings and the description below. Other features, objects, and advantages of the invention will be apparent from the description and drawings, and from the claims.

DETAILED DESCRIPTION OF THE INVENTION

Figure 1:
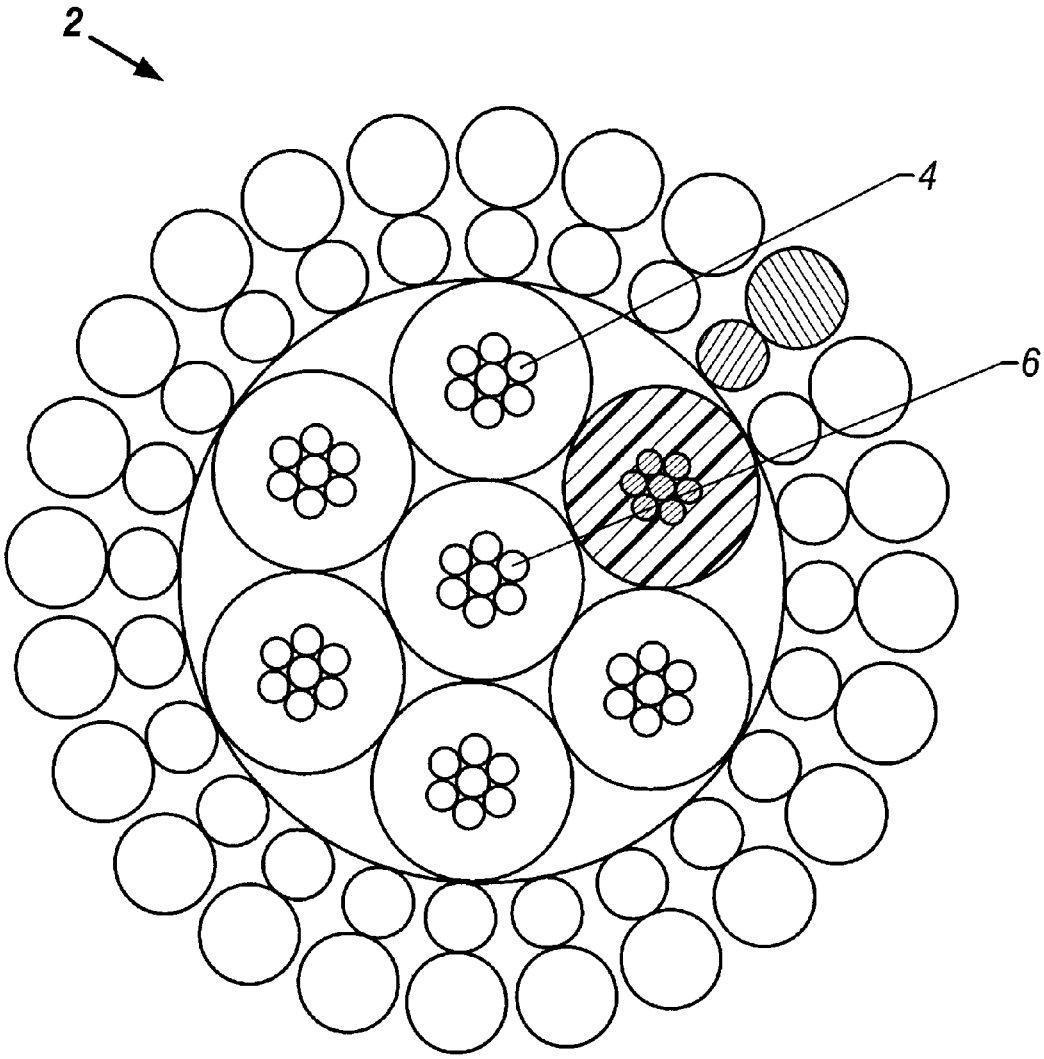
FIG. 1 Prior Art
FIG. 1 is a cross-sectional view of a heptacable.
Figure 2:
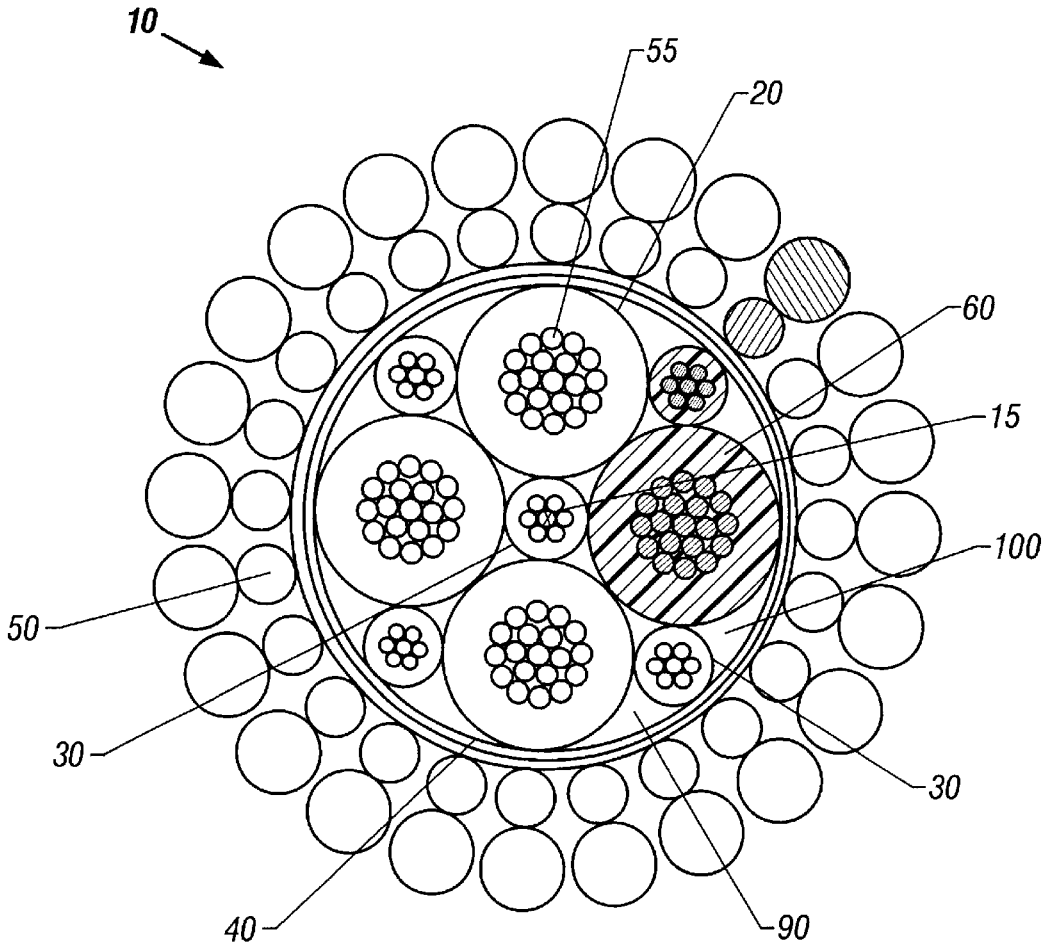
FIG. 2 is a cross-sectional view of a wireline cable of the invention having a center conductor.

Referring to FIG. 2, cable 10, defining a longitudinal axis 15, has four primary conductors 20 and five secondary conductors 30. A bedding layer 40 surrounds conductors 20 and 30, and an armor shield 50 surrounds bedding layer 40. The cable 10 has an overall diameter, including the armor shield 50, of less than about 0.55 inches.

Primary conductors 20 are used to transmit power and data along cable 10. Primary conductors 20 are insulated conductors arranged in a cross pattern extending about longitudinal axis 15 and define interstices 90 between adjacent primary conductors. Primary conductors 20 are twisted together around a secondary conductor 30 or a center filler rod 85 extending along longitudinal axis 15, as described below. At a given cross section of cable 10, primary conductors 20 are symmetrically located around longitudinal axis 15 in a square configuration. Primary conductors 20 are made of large stranded copper or copper alloy conductors 55 such that there are two sets of two diametrically opposed conductors 55. The conductors 55 are insulated with a thermoplastic or thermoset material 60 such as, for example, Teflon.

Secondary conductors 30 are also used to transmit power and data when needed and further provide cable 10 with backward compatibility, e.g., with a heptacable. Secondary conductors 30 are five insulated conductors extending about and along longitudinal axis 15. Four secondary conductors 30 are twisted together with primary conductors 20 and are partially nested in outer interstices 90 defined by primary conductors 20. At any given cross section of cable 10, secondary conductors 20 are symmetrically located in a cross pattern with two sets of two diametrically opposed secondary conductors 30. A fifth secondary conductor 30 extends along longitudinal axis 15, wrapped by primary conductors 20. Secondary conductors 30 are made of small stranded copper or copper alloy conductors. These conductors are insulated with a thermoplastic or thermoset material similar to the primary conductors.

Bedding layer 40 wraps around primary and secondary conductors 20 and 30. Depending on the application for cable 10, bedding layer 40 may include a binder tape. Together, bedding layer 40 and conductors 20 and 30 define interstitial voids 90 within cable core, which is filled with a semi-conductive or non-conductive filler 100. Filler 100 is a cross-linkable material such as, for example, nitrile rubber.

Armor shield 50 wraps around bedding layer 40 to provide cable 10 with added strength and a current return path. Armor shield 50 includes two layers of steel wire armor wound in opposite directions, i.e., contrahelically.

Figure 3:
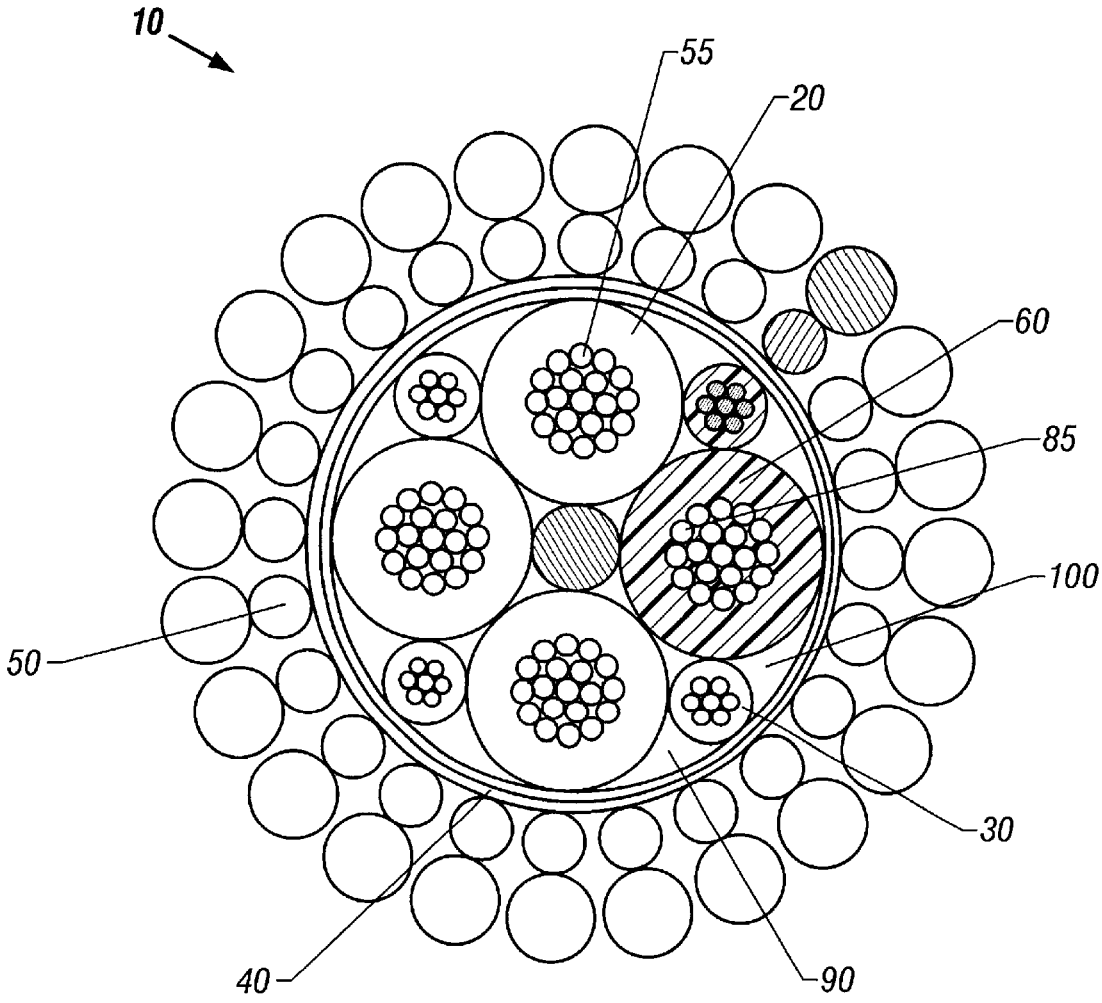
FIG. 3 is a cross-sectional view of a wireline cable of the invention having a center filler rod.

Referring to FIG. 3, in another embodiment of the invention, secondary conductor 30 extending along longitudinal axis 15 is replaced with a solid center filler rod 85. The center filler rod is made of thermoplastic or thermoset materials, most commonly fluoropolymers. The filler rod may replace the conductor if the central conductor is not required for backwards compatibility reasons.

A number of embodiments of the invention have been described. Nevertheless, it will be understood that various modifications may be made without departing from the spirit and scope of the invention.

For example, primary conductors 20 and secondary conductors 30 can be made of conductors having different gauges. The gauges of the conductors 20, 30 can range from about 24 AWG to about 14 AWG. Cable 10 may include 0 to 5 secondary conductors 30. For example, one cable adapted to be fully backward compatible with a standard heptacable has four primary conductors and five secondary conductors. Smaller conductors may be paired to replace the function of a larger conductor in a standard heptacable.

Depending on application of cable 10 or the need for backward compatibility, one or more of secondary conductors 30 can be replaced with one or more filler strands (not shown). For example, if application of cable 10 requires only six conductors (and no secondary conductor 30 or filler rod 85 along longitudinal axis 15), then two secondary conductors 30 can be replaced with two filler strands. Filler strands help maintain circular cross section of cable 10 and are less expensive than copper secondary conductors.

The bedding layer 40 may be covered with an extrudable material such as Teflon to serve as an armor-bedding layer.

Other embodiments are within the scope of the following claims.

What is claimed is:

1. A flexible electrical wireline cable defining a longitudinal axis and comprising:

four insulated primary conductors extending along the cable and defining interstices between adjacent primary conductors;

at least one insulated secondary conductor of a wire gauge smaller than the primary conductors and extending about the longitudinal axis of the cable, the at least one secondary conductor at least partially nested in one of the interstices; and an armor shield surrounding the primary conductors and the at least one secondary conductor.

2. The cable of claim 1, wherein the primary conductors are arranged in a cross pattern about the longitudinal axis.

3. The cable of claim 1, having at least three secondary conductors for a total number of at least seven conductors.

4. The cable of claim 3, having an overall diameter, including the armor shield, of less than about 0.55 inch.

5. The cable of claim 4, having a minimum bending radius of about 4 inches.

6. The cable of claim 3, having five secondary conductors.

7. The cable of claim 1, wherein the at least one secondary conductor extends along the longitudinal axis of the cable.

8. The cable of claim 7, wherein the primary conductors are twisted together about the at least one secondary conductor.

9. The cable of claim 1, further comprising a non-conductive filler rod extending about the longitudinal axis of the cable and at least partially nested in the interstices formed by the primary conductors.

10. The cable of claim 1, further comprising a non-conductive filler rod extending along the longitudinal axis.

11. The cable of claim 10, wherein the primary conductors are twisted together about the filler rod.

12. The cable of claim 11, wherein the filler rod includes a fluoropolymer.

13. The cable of claim 1, having a plurality of secondary conductors arranged symmetrically about the longitudinal axis.

14. The cable of claim 1 wherein the primary conductors, the at least one secondary conductor, and the armor shield define interstitial voids, the cable further comprising a non-conductive material disposed in the voids.

15. The cable of claim 14 wherein the non-conductive material is a cross-linked polymer.

16. The cable of claim 1 wherein the primary conductors, the at least one secondary conductor, and the armor shield define interstitial voids, the cable further comprising a semi-conductive material disposed in the voids.

17. The cable of claim 16 wherein the semi-conductive material is a cross-linked polymer.

18. The cable of claim 1, wherein the secondary conductor has a wire gauge of between 24 AWG and 20 AWG.

19. The cable of claim 1, further comprising a bedding layer surrounding the primary and secondary conductors.

20. The cable of claim 19, wherein the bedding layer includes a binder tape.

21. The cable of claim 20, wherein the bedding further includes an extruded material.

22. The cable of claim 1, wherein the armor shield includes two layers of contrahelically wound fibers.

23. The cable of claim 22, wherein the armor fibers comprise a material selected from a group consisting of steel, metals, and non-metals.

24. A flexible electrical cable defining a longitudinal axis and comprising:

four insulated primary conductors of a common wire gauge twisted together and extending along the cable, the primary conductors arranged in a cross pattern about the longitudinal axis and defining interstices between adjacent primary conductors;

five insulated secondary conductors of a wire gauge smaller than the wire gauge of the primary conductors, four of the secondary conductors each at least partially nested in one of said interstices, and a remaining secondary conductor extends along the longitudinal axis of the cable;

a bedding layer surrounding the primary and secondary conductors; and an armor shield surrounding the bedding layer, the cable having an outer diameter of less than about 0.55 inch.

* * * * *